US011253765B1

(12) United States Patent
Huang et al.

(10) Patent No.: US 11,253,765 B1
(45) Date of Patent: Feb. 22, 2022

(54) INTERACTIVE BOXING TRAINER

(71) Applicant: Eggplant Technologies Limited, Guangzhou (CN)

(72) Inventors: Jun Huang, Guangzhou (CN); Cheng Zhang, Guangzhou (CN)

(73) Assignees: Eggplant Technologies Limited, Guangzhou (CN); Xiamen Hengtuo Electronic & Information Co., Ltd., Xiamen (CN)

( * ) Notice: Subject to any disclaimer, the term of this patent is extended or adjusted under 35 U.S.C. 154(b) by 0 days.

(21) Appl. No.: 16/986,435

(22) Filed: Aug. 6, 2020

(51) Int. Cl.

| | |
|---|---|
| ***A63B 69/32*** | (2006.01) |
| ***A63B 69/34*** | (2006.01) |
| ***A63B 71/06*** | (2006.01) |
| ***A63B 24/00*** | (2006.01) |

(52) U.S. Cl.
CPC ..... *A63B 69/34* (2013.01); *A63B 24/0062* (2013.01); *A63B 71/0622* (2013.01); *A63B 2071/0694* (2013.01); *A63B 2220/40* (2013.01); *A63B 2220/833* (2013.01); *A63B 2225/093* (2013.01); *A63B 2225/50* (2013.01); *A63B 2244/102* (2013.01)

(58) Field of Classification Search
CPC ..... A63B 69/20; A63B 69/203; A63B 69/208; A63B 69/24; A63B 69/34
USPC ..... 482/83–90
See application file for complete search history.

(56) References Cited

U.S. PATENT DOCUMENTS 410,475 A * 9/1889 Widger ..... A63B 69/208 482/90
519,918 A * 5/1894 MacLearn ..... A63B 69/208 482/90
524,894 A * 8/1894 Forsberg ..... A63B 69/208 482/85
547,730 A * 10/1895 MacLearn ..... A63B 69/208 482/90
547,731 A * 10/1895 MacLearn ..... A63B 69/208 482/85
808,528 A * 12/1905 Finney et al. ..... A63B 69/208 482/90
925,342 A * 6/1909 Johnson ..... A63B 69/208 482/90
1,020,367 A * 3/1912 Patterson, Jr. ..... A63B 69/208 482/85
1,612,796 A * 12/1926 Abraham ..... A63B 69/208 482/90
1,890,696 A * 12/1932 Rosenhahn ..... A63B 69/208 482/90
2,082,272 A * 6/1937 Zinnow ..... A63B 69/208 482/90
3,022,072 A * 2/1962 Zinnow ..... A63B 69/208 482/90
4,330,119 A * 5/1982 Marshall, Jr. ..... A63B 69/20 482/84

(Continued)

*Primary Examiner* — Alvin A Hunter
(74) *Attorney, Agent, or Firm* — Karin L. Williams; Alan D. Kamrath; Mayer & Williams PC

(57) ABSTRACT

An interactive boxing trainer having a boxing object and a trainer is provided. An accelerometer is installed in the boxing head of the boxing object so that the acceleration of the boxing head can be sensed, and the force applied onto the boxing head, including its strength and direction, can be calculated accordingly. With this architecture, the cost of installation and maintenance is also reduced.

4 Claims, 5 Drawing Sheets

(56) References Cited

U.S. PATENT DOCUMENTS 4,486,016 A * 12/1984 Rubin ..... A63B 69/24 482/90
5,527,185 A * 6/1996 Davis ..... A63B 69/34 434/247
5,674,157 A * 10/1997 Wilkinson ..... A63B 5/11 482/27
5,723,786 A * 3/1998 Klapman ..... G01P 15/18 482/84
5,899,835 A * 5/1999 Puranda ..... A63B 69/34 482/90
6,390,958 B1 * 5/2002 Chu ..... A63B 69/20 482/83
6,398,697 B1 * 6/2002 Nichols, Jr. ..... A63B 69/20 473/441
6,786,854 B1 * 9/2004 Hsu ..... A63B 69/208 482/83
7,308,818 B2 * 12/2007 Considine ..... A63B 69/20 73/12.09
7,426,878 B2 * 9/2008 Lian ..... A63B 69/20 463/36
7,485,075 B2 * 2/2009 Ghim ..... A63B 69/20 482/83
7,491,139 B2 * 2/2009 Bridge ..... A63B 69/0095 473/422
7,651,447 B2 * 1/2010 Yang ..... A63B 69/20 482/85
7,704,194 B1 * 4/2010 Chen ..... A63B 69/208 482/87
7,766,799 B1 * 8/2010 Chen ..... A63B 69/208 482/85
7,794,370 B2 * 9/2010 Tackett ..... A63B 69/20 482/83
7,857,729 B2 * 12/2010 Sullivan ..... A63B 69/34 482/4
8,011,222 B2 * 9/2011 Wiber ..... A43B 1/0036 73/12.09
8,246,493 B1 * 8/2012 Ling ..... A63B 21/169 473/417
8,641,583 B2 * 2/2014 Chen ..... A63B 69/20 482/83
8,814,759 B2 * 8/2014 Goldy ..... A63B 71/0036 482/83
8,932,155 B2 * 1/2015 Moore ..... A63B 69/0091 473/423
9,067,115 B2 * 6/2015 Fu ..... A63B 21/00069
9,227,128 B1 * 1/2016 Carfagna, Jr. ..... A63B 24/0087
9,956,466 B2 * 5/2018 Fu ..... A63B 69/201
10,252,135 B1 * 4/2019 Roberts ..... A63B 69/0053
10,315,092 B2 * 6/2019 Chen ..... A63B 69/20
2005/0266967 A1 * 12/2005 Considine ..... A63B 69/32 482/84

* cited by examiner

INTERACTIVE BOXING TRAINER

FIELD OF THE INVENTION

This disclosure is related to an interactive boxing trainer, and, more particularly, to a trainer capable of reporting the strength and direction of the punch.

BACKGROUND OF THE INVENTION

The boxing training nowadays is usually taking place in a specific field and with one or more fixed sandbags. The trainee could hardly perceive whether the angle and/or the strength of his punch meets the training goal. Further, the conventional sensors need to be disposed near the surface of the sandbag. If the trainee fails to precisely hit the specified position, the sensed punch strength by the sensor would be inaccurate. Accordingly, there must be several sensors setup at different positions of the sandbag and the cost of installation and maintenance increases.

SUMMARY OF THE INVENTION

In this disclosure, the speed and position of the boxing head of the trainer is calculated so that the direction and the strength of the punch force onto the boxing head is accordingly accurately obtained and displayed. Further, the cost of installation and/or maintenance is reduced.

In one embodiment of this disclosure, the interactive boxing trainer has a boxing object and a trainer. The boxing object has a base stand, a swing rod, and a boxing head. The swing rod has an elastic portion connected to and between a first connecting portion and a second connecting portion. The first connecting portion is connected to the base stand. The boxing head is coupled to the second connecting portion of the swing rod and swingable when being hit. The trainer has a detector and a simulator. The detector is located in the boxing head and having a first microprocessor, an accelerometer, and a wireless transmitter. The first microprocessor is electrically connected to the accelerometer and the wireless transmitter, respectively. The simulator has a second microprocessor, a wireless receiver, an arithmetic logic unit, and a display. The second microprocessor is electrically connected to the wireless receiver, the arithmetic logic unit, and the display, respectively. The accelerometer is capable of detecting an acceleration of the boxing head and generating a piece of sensing signal, and the sensing signal is sent by the wireless transmitter and received by the wireless receiver. The arithmetic logic unit is configured to calculate a strength and a direction of a force applied onto the boxing head according to the sensing signal and the display is configured to display information of the direction and the force.

In another embodiment of this disclosure, the base stand has a base housing and a plurality of suckers. The suckers is underneath and connected to the base housing. A cavity is defined in the base housing and there are a water inlet cover and a socket of a surface of the base housing. The water inlet cover is removable for injecting weighting fluid into or removing the weighting fluid from the cavity. The socket is capable of containing and fixing the first connecting portion of the swing rod.

In another embodiment of this disclosure, the interactive boxing trainer further has a supporting rod assembly connected to and between the second connecting portion and the boxing head.

In another embodiment of this disclosure, the supporting rod assembly has a first supporting rod and a second supporting rod. The first supporting rod has one end connected to the second connecting portion of the swing rod. The first supporting rod also has a plurality of positioning holes separated from one another with a predetermined distance. The second supporting rod is slidably inserted within the first supporting rod along an axial direction and having at least one positioning protrusion thereon. The positioning protrusion is aligned with one of the positioning holes so as to define and fix the length of the supporting rod assembly.

In another embodiment of this disclosure, the boxing head has a ball and an indicator. The indicator is connected to the ball, wherein the indicator has a main body, at least one indicating lamp on the main body, and a switch. The main body is also connected to the second supporting rod and the detector is disposed within the main body.

BRIEF DESCRIPTION OF THE DRAWINGS

A more detailed understanding may be had from the following description, given by way of example in conjunction with the accompanying drawings wherein.

DETAILED DESCRIPTION OF THE PREFERRED EMBODIMENTS

Figure 1:
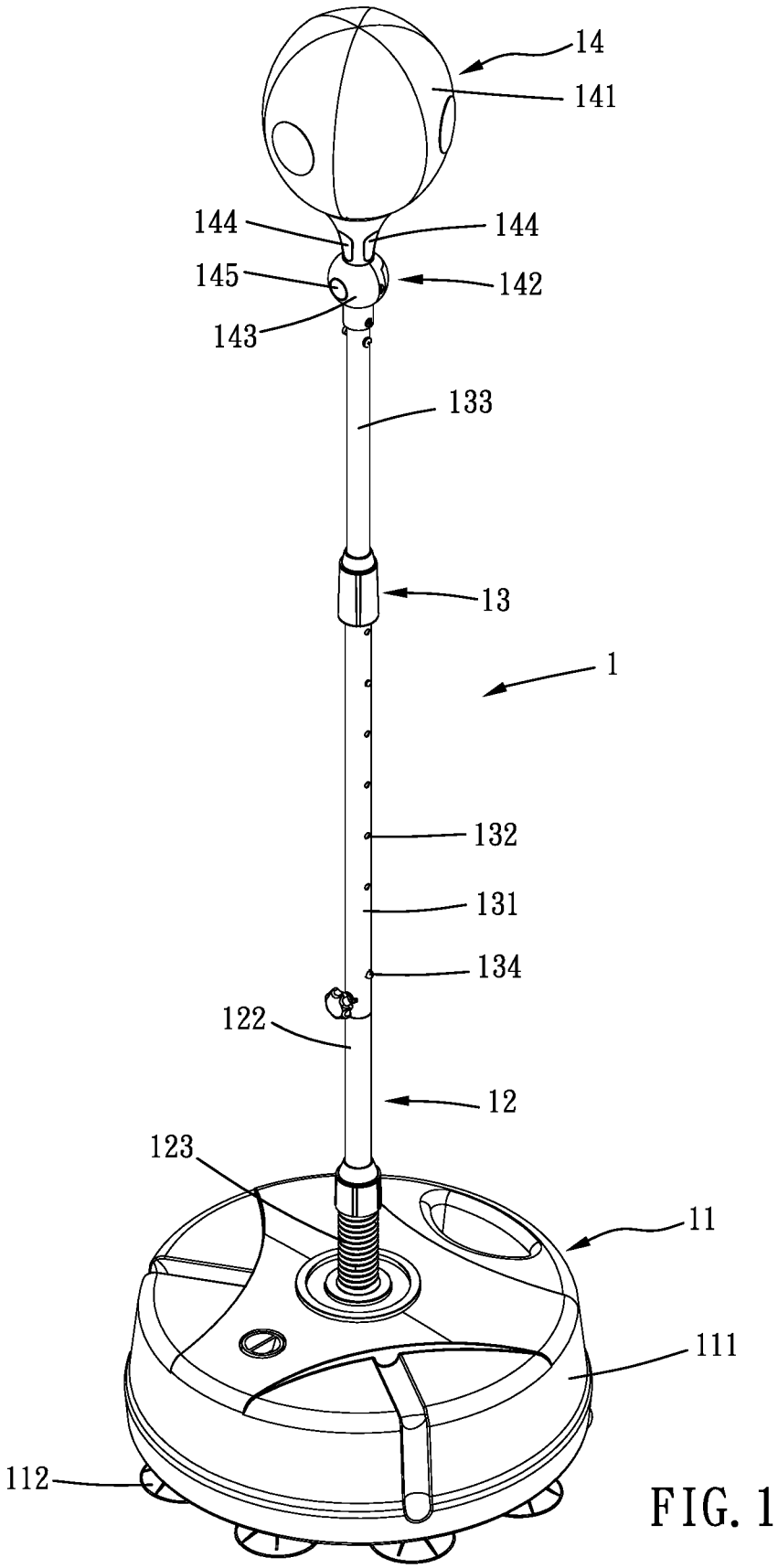
FIG. 1 is a 3-D structural diagram of the interactive boxing trainer in one embodiment of this disclosure.
Figure 2:
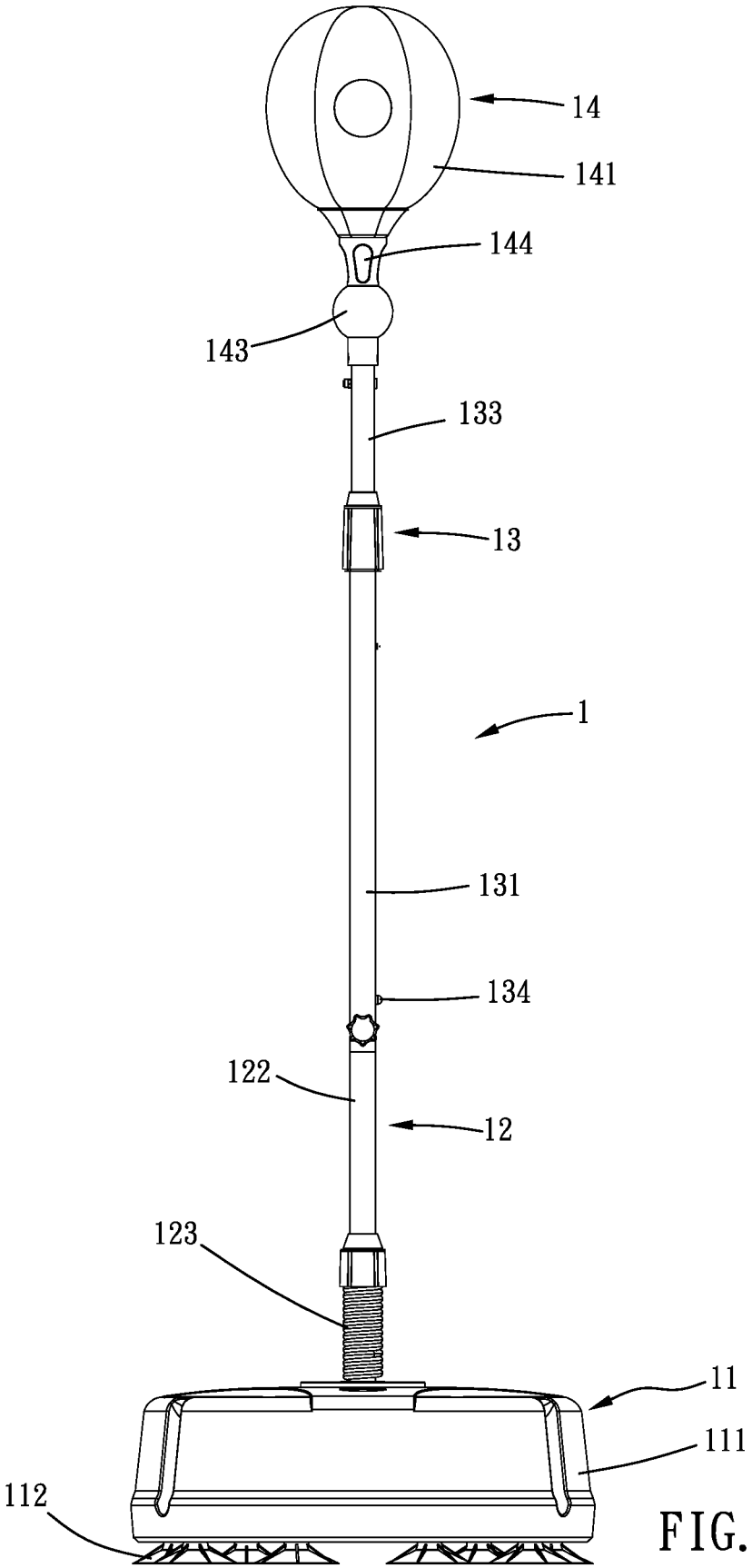
FIG. 2 is a sideview diagram of the interactive boxing trainer in one embodiment of this disclosure.
Figure 3:
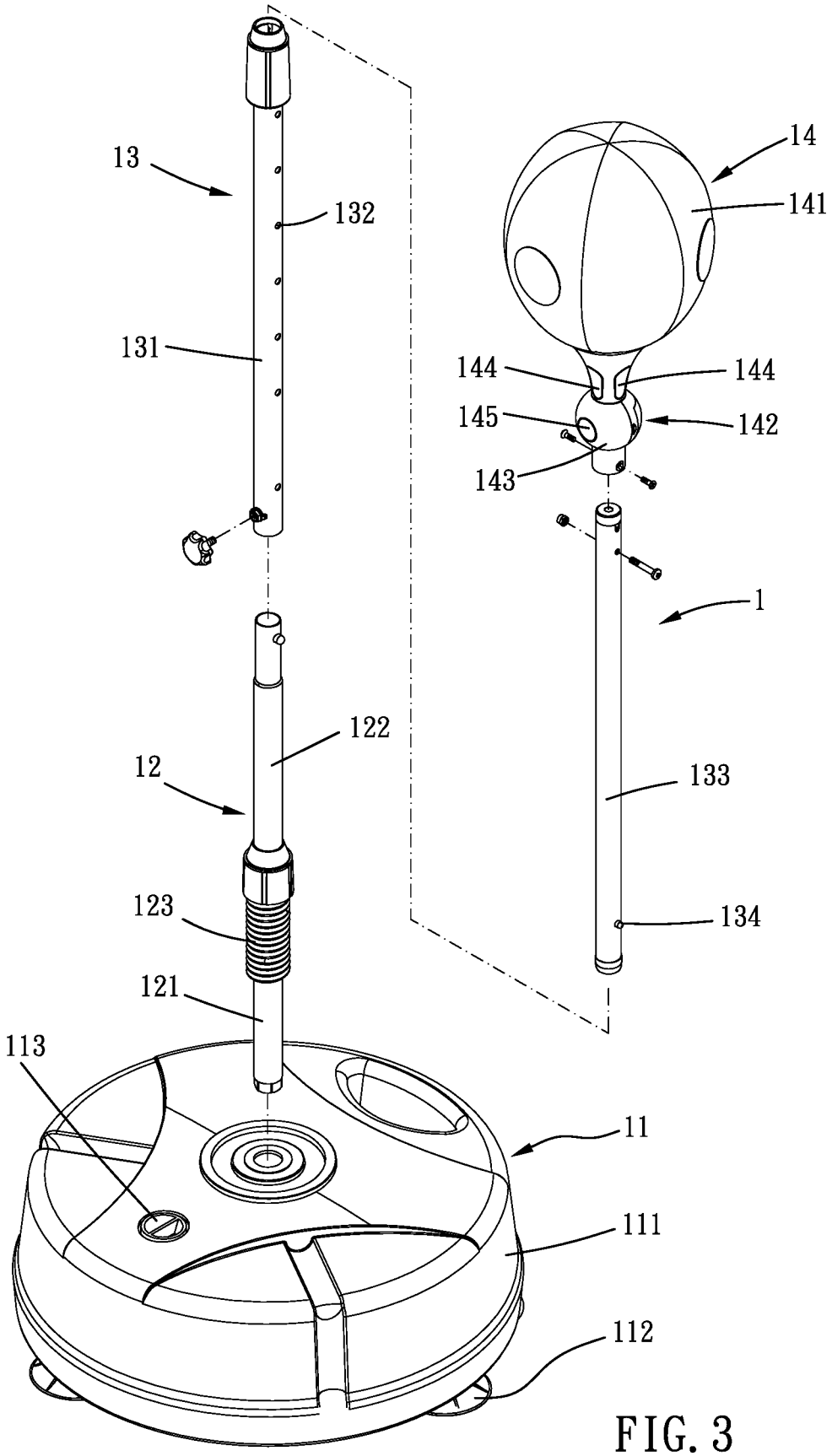
FIG. 3 is an explosive diagram of the interactive boxing trainer in one embodiment of this disclosure.
Figure 4:
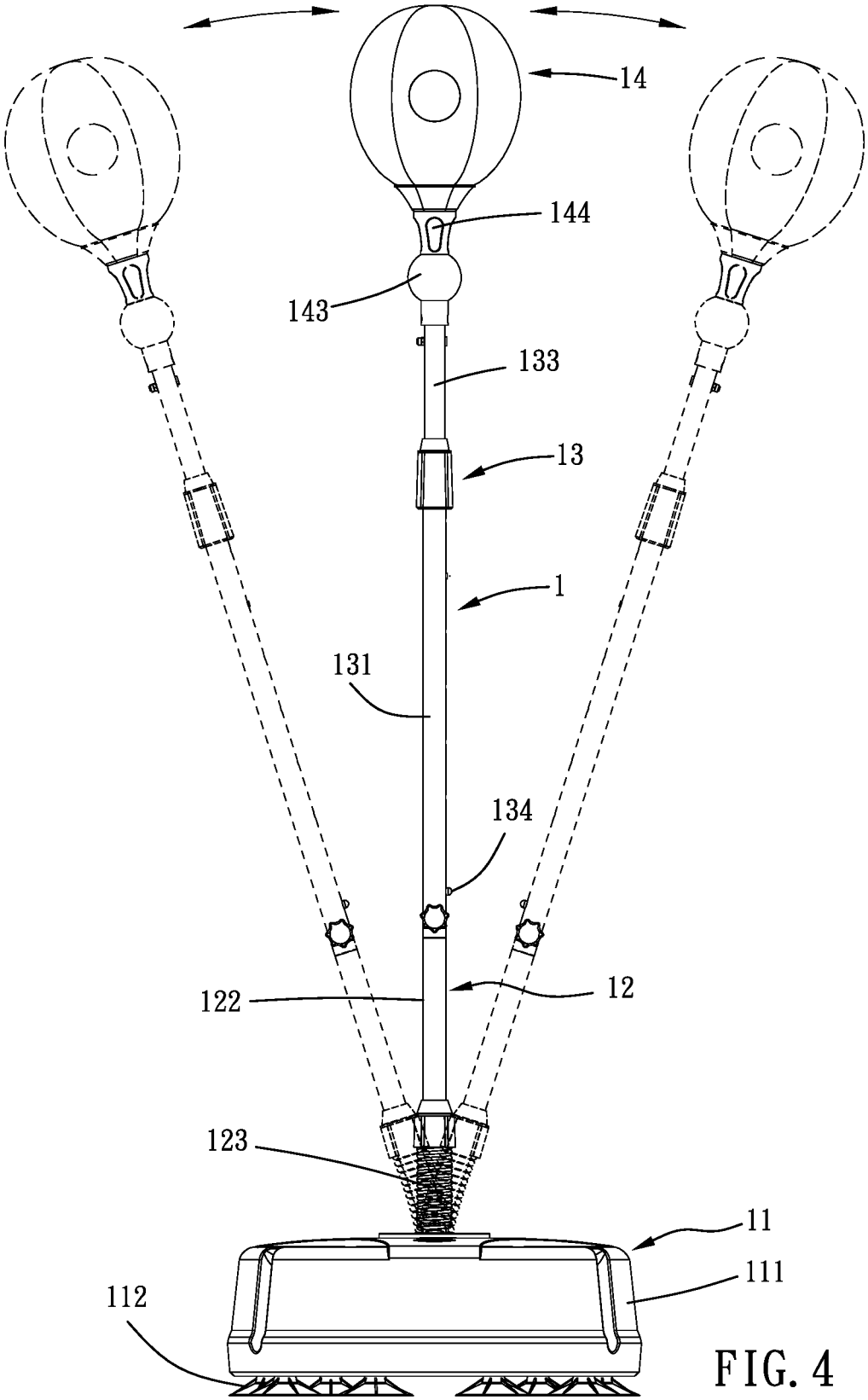
FIG. 4 is illustrating the operation of the interactive boxing trainer in one embodiment of this disclosure.

As to the exemplary embodiment of this disclosure, please refer to FIG. 1 to FIG. 5. As shown in these figures, the interactive boxing trainer in this disclosure includes a boxing object 1 and a trainer 2. The boxing object 1 has a base stand 11, a swing rod 12, a supporting rod assembly 13, and a boxing head 14.

The base stand 11 has a base housing 111 and a plurality of suckers 112 underneath and connected to the base housing 111. The base housing 111 has a cavity therein and a water inlet cover 113 as well as a socket 114 thereon. The water inlet cover 113 could be removed by a user so that weighting fluid could be injected into or removed from the cavity of the base housing 111. The socket 114 is capable of containing the first connecting portion 121 of the swing rod 12 so as to fix the swing rod 12. The swing rod 12 also has a second connecting portion 122 and an elastic portion 123 between the first connecting portion 121 and the second connecting portion 122.

The supporting rod assembly 13 has a first supporting rod 131 and a second supporting rod 133. A first end of the first supporting rod 131 is connected to the second connecting portion 122 of the swing rod 12 while the second supporting rod 133 is inserted into the first supporting rod 131 along the axial direction. The first supporting rod 131 has a plurality of positioning holes 132 thereon, and those positioning holes 132 are separated from one another with a predetermined distance so that the length of the supporting rod assembly 13 could be adjusted by selectively setting the positioning protrusion 134 to one of the positioning holes 132.

The boxing head 14 has a ball 141 and an indicator 142 connected to one side of the ball 141. The indicator 142 has a main body 143, an indicating lamp 144 disposed on the main body 143, and a switch 145. The main body 143 is connected to the second supporting rod 133 of the supporting rod assembly 13.

Figure 5:
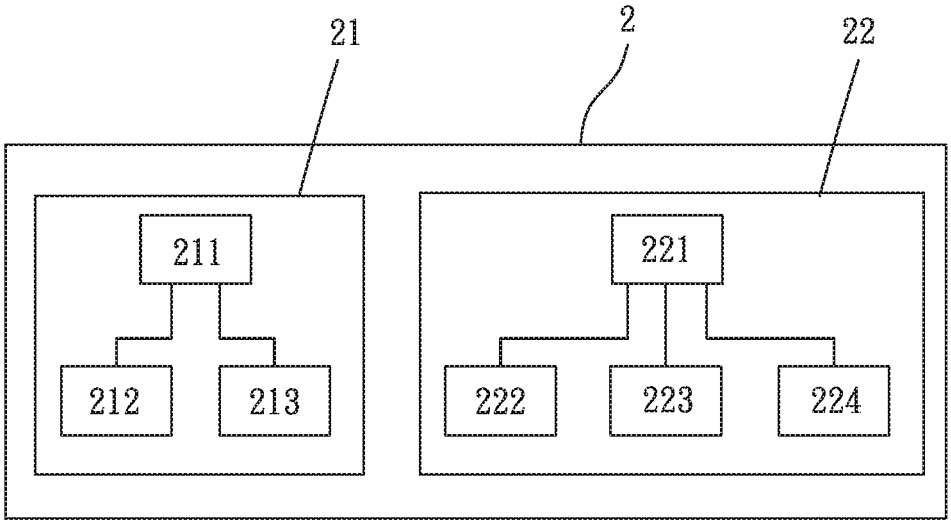
FIG. 5 is the block diagram of the trainer of the interactive boxing trainer in one embodiment of this disclosure.

The trainer 2, which is shown in FIG. 5, has a detector 21 and a simulator 22. The detector 21 is located inside the main body 143 and having a first microprocessor 211 which is electrically connected to an accelerometer 212 and a wireless transmitter 213, respectively. The simulator 22 has a second microprocessor 221 which is electrically connected to a wireless receiver 222, an arithmetic logic unit (ALU) 223, and a display 224, respectively.

In one embodiment, when the trainee is going to use the boxing trainer in this disclosure, the boxing object 1 is fixed on the ground by the suckers 112, and the water inlet cover 113 is removed so as to inject weighting fluid such as water into the base stand 11. Further, the height of the boxing head 14 is adjusted by moving the second supporting rod 133 so as to allow the positioning protrusion 134 to match the specified positioning hole 132.

When the trainee hit the ball 141, the boxing head 14 swings around the elastic portion 123. The accelerometer 212 of the detector 21 is capable of sensing the acceleration of the boxing head 14 and generating pieces of the sensing signal. The sensing signal is sent by the wireless transmitter 213 and received by the wireless receiver 222 of the simulator 22. The ALU 223 is capable of obtaining the position and velocity of the boxing head 14 based on the current sensing signal and at least one historic sensing signal. Based on the calculated information, the mass of the boxing head, and the preset parameters of the elastic portion 123, the strength and the angle of the punch force onto the boxing head 14 is then calculated and displayed on the display 224. Therefore, the trainee is capable of perceiving whether the punch meets the requirements of the training course. Further, no matter whether the sensor is precisely hit or not, the strength is accurately estimated.

In one embodiment, when the switch 145 is turned on, the indicating lamps 144 are capable of indicating the direction of the punch onto the boxing head 14. In some embodiments, the indicating lamps 144 and the switch 145 are removed.

Embodiments Although features and elements are described above in particular combinations, one of ordinary skill in the art will appreciate that each feature or element can be used alone or in any combination with the other features and elements. In addition, the methods described herein may be implemented in a computer program, software, or firmware incorporated in a computer-readable medium for execution by a computer or processor.

What is claimed is:

1. An interactive boxing trainer comprising:

a boxing object, comprising:

a base stand;

a swing rod having a first connecting portion, a second connecting portion, and an elastic portion connected to and between the first connecting portion and the second connecting portion, wherein the first connecting portion is connected to the base stand; and a boxing head coupled to the second connecting portion of the swing rod and swingable when being hit; and a trainer, comprising:

a detector in the boxing head, having a first microprocessor, an accelerometer, and a wireless transmitter, wherein the first microprocessor is electrically connected to the accelerometer and the wireless transmitter, respectively;

a simulator having a second microprocessor, a wireless receiver, an arithmetic logic unit, and a display, wherein the second microprocessor is electrically connected to the wireless receiver, the arithmetic logic unit, and the display, respectively; and a supporting rod assembly connected to and between the second connecting portion and the boxing head, wherein the accelerometer is capable of detecting an acceleration of the boxing head and generating a piece of sensing signal, and the sensing signal is sent by the wireless transmitter and received by the wireless receiver, wherein the supporting rod assembly comprises: a first supporting rod with one end connected to the second connecting portion of the swing rod, having a plurality of positioning holes separated from one another with a predetermined distance; and a second supporting rod slidably inserted within the first supporting rod along an axial direction, having at least one positioning protrusion;

wherein the positioning protrusion is aligned with one of the positioning holes so as to define and fix the length of the supporting rod assembly, wherein the arithmetic logic unit is configured to calculate a strength and a direction of a force applied onto the boxing head according to the sensing signal and the display is configured to display information of the direction and the force, wherein the boxing head comprises:

a ball; and an indicator connected to the ball, wherein the indicator comprises a main body, at least one indicating lamp on the main body, and a switch, and wherein the main body is connected to the second supporting rod and the detector is disposed within the main body.

2. The interactive boxing trainer in claim 1, wherein the base stand comprises:

a base housing; and a plurality of suckers underneath and connected to the base housing, wherein a cavity is defined in the base housing and there are a water inlet cover and a socket of a surface of the base housing, wherein the water inlet cover is removable for injecting weighting fluid into or removing the weighting fluid from the cavity, and wherein the socket is capable of fixing the first connecting portion of the swing rod.

3. An interactive boxing trainer comprising:

a boxing object, comprising:

a base stand;

a swing rod having a first connecting portion, a second connecting portion, and an elastic portion connected to and between the first connecting portion and the second connecting portion, wherein the first connecting portion is connected to the base stand; and a boxing head coupled to the second connecting portion of the swing rod and swingable when being hit; and a trainer, comprising:

a detector in the boxing head, having a first microprocessor, an accelerometer, and a wireless transmitter, wherein the first microprocessor is electrically connected to the accelerometer and the wireless transmitter, respectively; and a simulator having a second microprocessor, a wireless receiver, an arithmetic logic unit, and a display, wherein the second microprocessor is electrically connected to the wireless receiver, the arithmetic logic unit, and the display, respectively, wherein the accelerometer is capable of detecting an acceleration of the boxing head and generating a piece of sensing signal, and the sensing signal is sent by the wireless transmitter and received by the wireless receiver, wherein the arithmetic logic unit is configured to calculate a strength and a direction of a force applied onto the boxing head according to the sensing signal and the display is configured to display information of the direction and the force, and wherein the boxing head comprises:

a ball; and an indicator connected to the ball, wherein the indicator comprises a main body, at least one indicating lamp on the main body, and a switch, wherein the main body is coupled to the swing rod and the detector is disposed within the main body.

4. The interactive boxing trainer in claim 3, wherein the base stand comprises:

a base housing; and a plurality of suckers underneath and connected to the base housing, wherein a cavity is defined in the base housing and there are a water inlet cover and a socket of a surface of the base housing, wherein the water inlet cover is removable for injecting weighting fluid into or removing the weighting fluid from the cavity, and wherein the socket is capable of fixing the first connecting portion of the swing rod.

* * * * *